US005309129A

United States Patent [19]

Arnold et al.

[11] Patent Number: 5,309,129

[45] Date of Patent: May 3, 1994

[54] APPARATUS AND METHOD FOR PROVIDING TEMPERATURE COMPENSATION IN $TE_{101}$ MODE AND $TM_{010}$ MODE CAVITY RESONATORS

[75] Inventors: Pitt W. Arnold, Phoenix; Tage V. Jensen, Tempe, both of Ariz.

[73] Assignee: Radio Frequency Systems, Inc., Phoenix, Ariz.

[21] Appl. No.: 932,651

[22] Filed: Aug. 20, 1992

[51] Int. Cl.[5] ..... H01P 1/30; H01P 7/06

[52] U.S. Cl. ..... 333/229; 333/232; 333/234

[58] Field of Search ..... 333/202, 208, 209, 227-234, 333/235

[56] References Cited

U.S. PATENT DOCUMENTS

| | | | |
|---|---|---|---|
| 3,873,949 | 3/1975 | Dorsi et al. | 333/229 X |
| 4,057,772 | 11/1977 | Basil, Jr. et al. | 333/229 |
| 4,207,548 | 6/1980 | Graham et al. | 333/225 |
| 4,249,148 | 2/1981 | Jachowski | 333/209 X |
| 4,423,398 | 12/1983 | Jachowski | 333/229 |
| 4,488,132 | 12/1984 | Collins et al. | 333/229 |
| 4,661,790 | 4/1987 | Gannon et al. | 333/235 X |
| 4,677,403 | 6/1987 | Kich | 333/234 X |
| 4,896,125 | 1/1990 | Blair, Jr. et al. | 333/230 X |

*Primary Examiner*—Seungsook Ham

*Attorney, Agent, or Firm*—Ware, Fressola, Van Der Sluys & Adolphson

[57] ABSTRACT

A $TE_{101}$ mode cavity resonator housing 60 has a truss 70 securely mounted to one of its broadwalls 72. The truss 70 is fabricated from a material having a lesser coefficient of expansion than that of the material from which the housing 60 is fabricated. The difference between the coefficients of expansion results in a difference in expansion and contraction of the materials over temperature. The thermal expansions and contractions in the housing 60 material result in variations in the natural resonant frequency of the housing 60. These variations in natural resonant frequency are compensated by offsetting thermal expansions and contractions in the truss 70 material.

25 Claims, 6 Drawing Sheets

FIG. 13
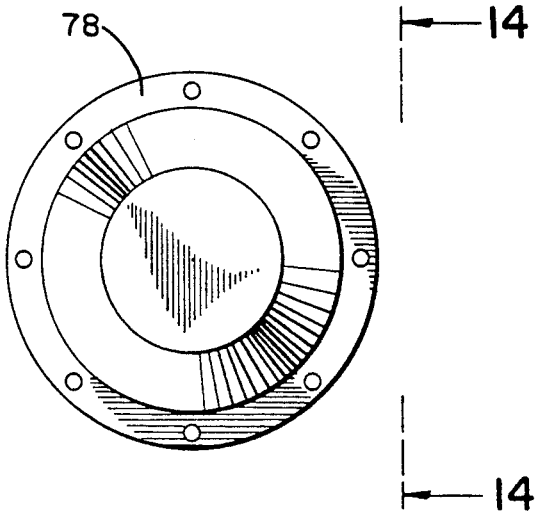
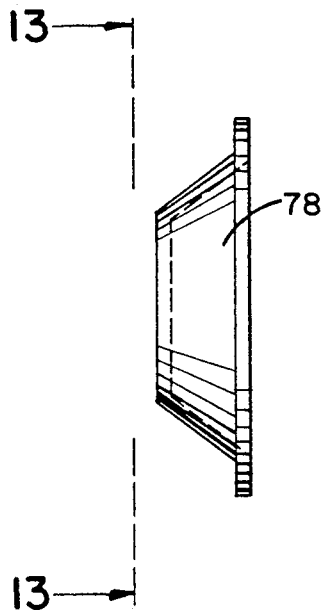
FIG. 14

APPARATUS AND METHOD FOR PROVIDING TEMPERATURE COMPENSATION IN $TE_{101}$ MODE AND $TM_{010}$ MODE CAVITY RESONATORS

BACKGROUND OF THE INVENTION

1. Field of the Invention

The present invention relates to cavity resonators and, more particularly, to an apparatus and method for providing temperature compensation in $TE_{101}$ mode and $TM_{010}$ mode cavity resonators.

2. Description of the Prior Art

The use of a cavity resonator for high frequency filtering purposes is well known in the art. The cavity resonator is generally realized in the form of an enclosed housing that is constructed from a material having a high conductivity. This conductive housing furnishes large areas for current to flow and confines electromagnetic fields therein. Such a housing exhibits a natural resonant frequency and generally has a very high quality factor (Q). However, when the cavity resonator housing is subject to temperature variations, there are corresponding variations in the natural resonant frequency and the Q due to thermal expansions and contractions of the housing material. For example, if a cavity resonator housing is constructed of copper, which has a coefficient of expansion of about 9.3 ppm/°F., an increase in temperature will cause a corresponding increase in the housing dimensions and thereby a decrease in the resonant frequency. Specifically, in the above case the frequency will decrease by 9.3 Hz/MHz/°F., which is too large a variation for applications requiring a high operating selectivity. It is therefore desirable to provide compensation for such thermal variations so as to maintain consistent cavity resonator frequency characteristics.

One prior art method for providing temperature compensation for the thermal expansion and contraction of a cavity resonator housing has been to construct the housing from a material commonly known as Invar. Invar is a metallic compound having a coefficient of expansion of approximately 0.5 ppm/°F. Thus, when a cavity resonator constructed of Invar is subject to temperature variations, the resulting frequency variations are very small when compared to a cavity resonator constructed of copper. However, the resulting frequency variation with temperature of a cavity resonator constructed with Invar may still be too large in high selectivity applications. Furthermore, due to a high cost of Invar it would be more desirable to construct a cavity resonator housing of a more conventional and less costly material, such as copper, copper plated steel, or copper plated aluminum.

Another prior art method for providing temperature compensation in a cavity resonator housing is described in U.S. Pat. No. 4,423,398, entitled, Internal Bi-Metallic Temperature Compensating Device For Tuned Cavities, issued Dec. 27, 1983. This patent described how a strip of temperature sensitive bi-metallic material is used to provide temperature compensation by way of a reformation of the bi-metallic material over temperature. A problem with this method, however, is that the temperature compensating effects can be somewhat inconsistent because of a dependence on a large number of variables; i.e., position of the strip, dimensions of the strip, relative angle of the strip, material of the strip, etc. It is therefore desirable to overcome the above-mentioned shortcomings while providing a simple, low cost, highly reliable and accurate temperature compensation scheme for high frequency cavity resonators.

SUMMARY OF THE INVENTION

The present invention contemplates a method for providing a simple, low cost, highly reliable and accurate temperature compensation scheme for use in high frequency cavity resonators. This method is realized by utilizing the normally adverse thermal expansions and contractions of a cavity resonator housing over temperature in a way that compensates for corresponding variations in natural resonant frequency. Such a method is particularly useful in the application of $TE_{101}$ mode and $TM_{010}$ mode cavity resonators since these cavity resonators operate at low order modes and therefore require relatively small volumes.

Cavity resonators supporting the $TE_{101}$ and $TM_{010}$ modes have very similar internal field distributions and therefore both can be temperature compensated by similar methods. The $TE_{101}$ mode cavity resonator is rectangular in shape with its two largest walls, or broadwalls, being separated by a dimension H. The $TM_{010}$ mode cavity resonator is cylindrical in shape with its two end walls, or broadwalls, being separated by a similar dimension H. Generally, the dimension H, or the separation between the broadwalls, controls only the Q factor and not the resonant frequency. However, this is only true if the dimension H is uniform over the entire broadwall surfaces. Thus, if the dimension H is varied over the broadwall surfaces, the natural resonant frequency can be affected. In fact, the frequency response of a $TE_{101}$ mode cavity resonator or a $TM_{010}$ mode cavity resonator can be affected by deflecting the center of one of the two resident broadwalls. Specifically, a deflection in the center of one of the broadwalls that increases the H dimension results in an increase in the natural resonant frequency, and a deflection in the center of one of the broadwalls that decreases the H dimension results in a decrease in the natural resonant frequency.

The present invention utilizes the above-described effect on frequency response to offset changes in the natural resonant frequency of a cavity resonator caused by thermal variations in the dimensions of the cavity resonator housing. In particular, the present invention utilizes a truss having a center section and two limbs, that is positioned inside the housing at the center of one of the cavity resonator broadwalls so as to produce a frequency response effect similar to that described above. The position of the truss is maintained by securing the end of each limb to the surface of the broadwall while spacing its center a predetermined distance from the broadwall surface. The truss is fabricated from a material having a lower coefficient of expansion than the material from which the cavity resonator is fabricated. Thus, thermal expansions and contractions in the truss material are lesser than thermal expansions and contractions in the cavity resonator housing material. This difference in thermal variations results in an increase in the H dimension for an increase in temperature and a corresponding increase in the natural resonant frequency. This increase in natural resonant frequency offsets the decrease in natural resonant frequency caused by the thermal expansion of the cavity resonator housing dimensions. Similarly, a decrease in the H dimension for decreasing temperature results in a corresponding decrease in the natural resonant frequency, thereby offsetting the increase in natural resonant frequency caused by the thermal contraction of the cavity resonator housing dimensions. It is thus apparent how the present invention can overcome the above-mentioned shortcomings for providing a temperature compensation scheme for high frequency cavity resonators.

Accordingly, the primary objective of the present invention is to provide a simple, low cost, highly reliable and accurate temperature compensation scheme for high frequency cavity resonators.

BRIEF DESCRIPTION OF THE DRAWINGS

FIG. 13 is a top view taken along line 13—13 of FIG. 14 of a truncated cone structure which may be used to provide temperature compensation according to the present invention.

FIG. 14 is side view taken along line 14—14 of FIG. 13 of the truncated cone structure shown in FIG. 13.

DETAILED DESCRIPTION OF THE PRESENT INVENTION

Figure 1:
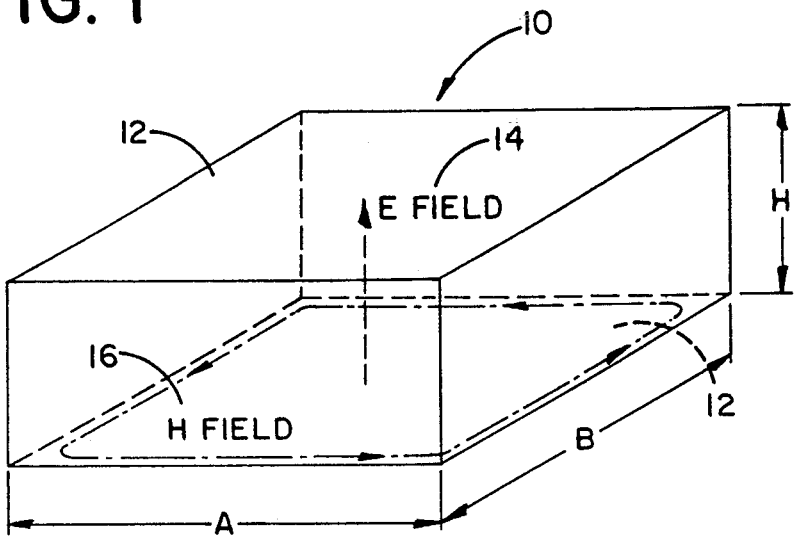
FIG. 1 is a three-dimensional representation of a $TE_{101}$ mode cavity resonator housing.

Referring to FIG. 1, there is shown a three-dimensional representation of a cavity resonator housing 10 for supporting a dominant $TE_{101}$ waveguide mode. The housing 10 is rectangular in shape with its two largest walls 12, or broadwalls, being separated by a dimension H. Within the housing 10 there is an electric 14 and a magnetic 16 field distribution, each having an orientation as indicated. A relation for determining the natural resonant frequency of such a cavity resonator housing 10 is as follows, $$f_{101} = 5902\left(\frac{1}{A^2} + \frac{1}{B^2}\right)^{\frac{1}{2}},$$

wherein $f_{101}$ is in megahertz and the A and B dimensions are in inches.

Figure 2:
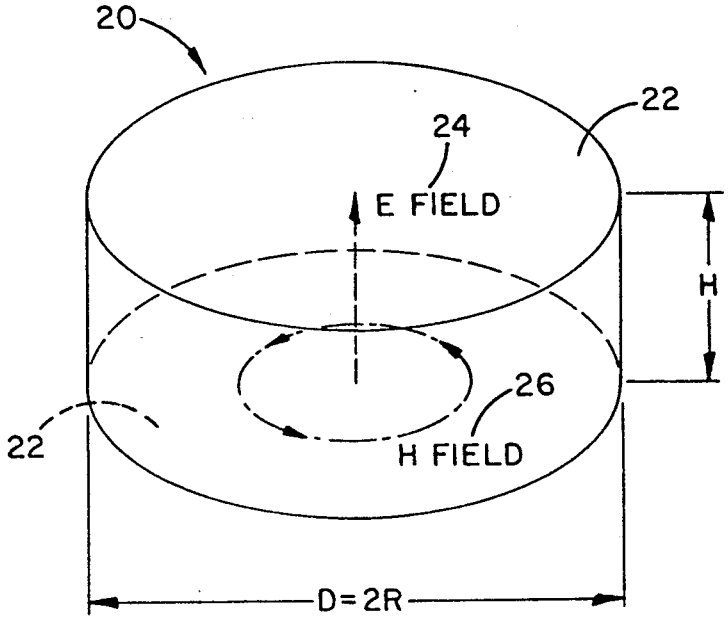
FIG. 2 is a three-dimensional representation of a $TM_{010}$ mode cavity resonator housing.

Referring to FIG. 2, there is shown a three-dimensional representation of a cavity resonator housing 20 for supporting a dominant $TM_{010}$ waveguide mode. The housing 20 is cylindrical in shape with its two end walls 22, or broadwalls, being separated by a dimension H, similar to the cavity resonator housing 10 of FIG. 1. Within the housing 20 there is an electric 24 and a magnetic 26 field distribution, each having an orientation as indicated. A relation for determining the natural resonant frequency of such a cavity resonator housing 20 is as follows, $$f_{010} = \frac{4522}{R},$$

wherein $f_{010}$ is in megahertz and R is in inches.

As can be deduced from both of the above stated relations, the dimension H, or the separation between the broadwalls 12, 22, is not a factor in determining the natural resonant frequency of either of the cavity resonator housings 10, 20. This is only true, however, if the dimension H is uniform over the dimensions A and B in the case of the $TE_{101}$ mode resonator housing 10, or over the radius R in the case of the $TM_{010}$ mode cavity resonator housing 20. In other words, the natural resonant frequency in either of the above-described cavity resonator housings 10, 20 can be affected by a variation in the dimension H over the area of the broadwalls 12, 22, respectively. Such an effect is realized by connecting a network analyzer to either of the above-mentioned cavity resonator housings 10, 20 and measuring the frequency response of a signal transmitted therethrough by coupling to the internally distributed fields 14, 16 and 24, 26, respectively. This measurement reveals that an increase or a decrease in the natural resonant frequency occurs when the dimension H is increased or decreased, respectively. The variation in the natural resonant frequency is greatest when the H dimension is varied at the center of the broadwalls 12, 22, since the electric field distributions 14, 24 are strongest at this point. This effect on natural resonant frequency is analogous to increasing or decreasing the capacitance of an ordinary resonant circuit, whereby the frequency is correspondingly decreased or increased, respectively.

The above-described technique for producing variations in natural resonant frequency is utilized to provide a temperature compensation scheme for cavity resonators. Such a utilization compensates for variations in the natural resonant frequency of the cavity resonator housing that result from dimensional variations in the housing caused by the heating and the cooling of the housing through ambient temperature variations, or increasing and decreasing the applied transmission power. The dimensions of the cavity resonator housing vary over temperature at a rate determined by the coefficient of expansion of the material from which the housing is constructed. These dimensional variations produce corresponding variations in the natural resonant frequency.

Figure 3:
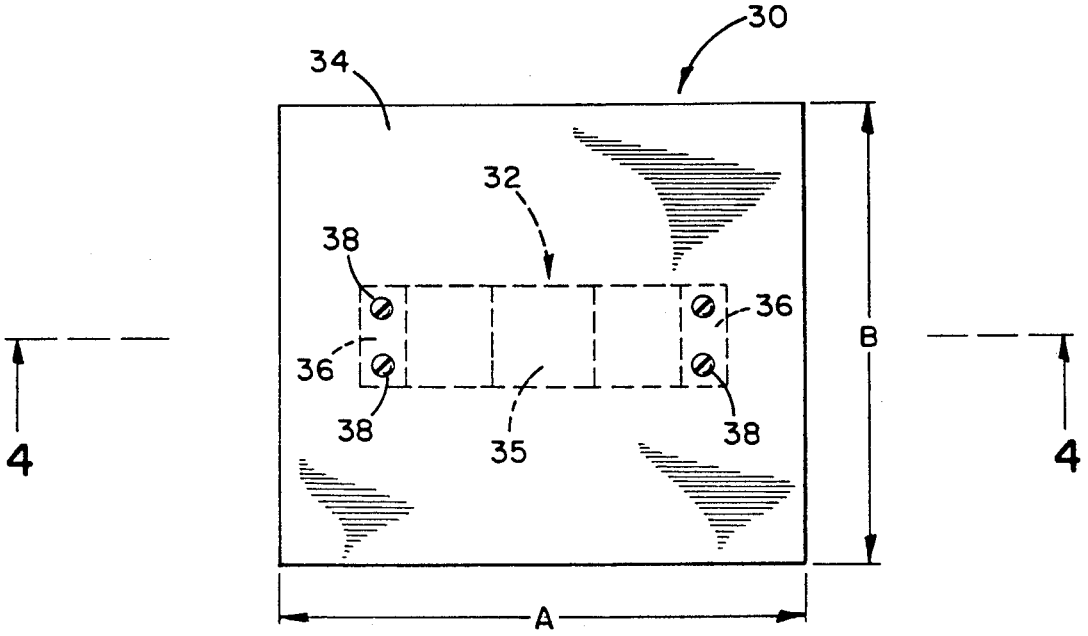
FIG. 3 is a top view taken along line 3—3 of FIG. 4 of a $TE_{101}$ mode cavity resonator housing employing a truss according to the present invention.

Referring to FIG. 3, there is shown a top view of a $TE_{101}$ mode cavity resonator housing 30 employing a truss 32 for providing temperature compensation according to the present invention. The truss 32, having a center section 35 and two limbs 36, is securely mounted within the housing 30 at the center of one of the housing broadwalls 34. The truss 32 is mounted to the broadwall 34 at the end of each limb 36 by a pair of bolts 38. Of course, any other means of securely mounting the truss 32 to the broadwall 34 are acceptable. It should be noted, however, that such a mounting must ensure that electrical contact is made between the truss 32 and the broadwall 34, and hence the housing 30, as both the truss 32 and the housing 30 are to be either partially or totally fabricated from some type of conductive material.

Figure 4:
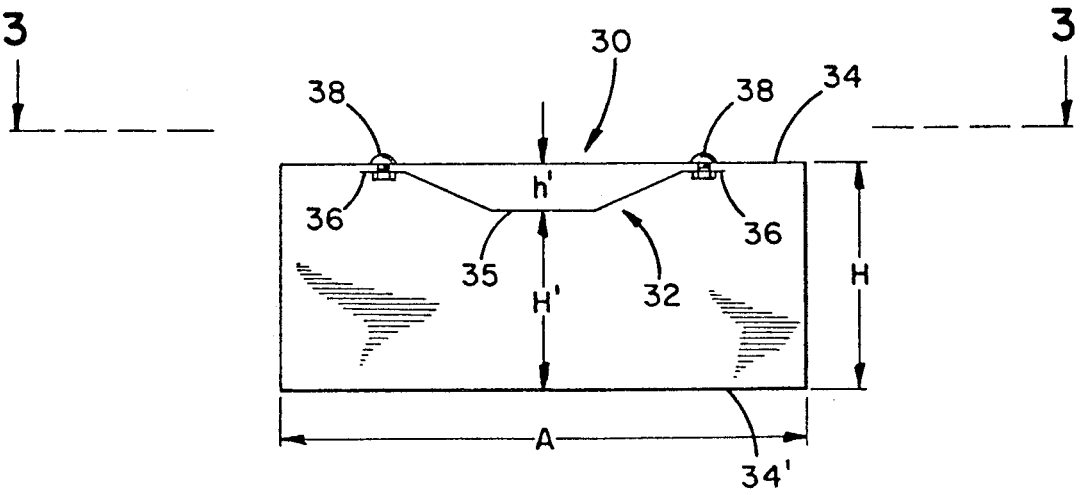
FIG. 4 is a side cross-sectional view taken along line 4—4 of FIG. 3 of a $TE_{101}$ mode cavity resonator housing employing a truss according to the present invention.

Referring to FIG. 4, there is shown a cross-sectional view of the $TE_{101}$ mode cavity resonator housing 30 with the internally mounted truss 32 as shown in FIG. 3. From this view it can be seen that the truss 32 is separated from the center of the broadwall 34 to which it is secured by a distance h'. On the other hand, the truss 32 is also separated from an opposite broadwall 34' by a distance H'. As will be described, this H' dimension, or more appropriately, a variation in this H' dimension provides a temperature compensating variation in the natural resonant frequency of the housing 30.

For purposes of this description, the housing 30 is assumed to be fabricated from copper. Of course, the housing 30 may also be fabricated from another material having a relatively high conductivity, or only the interior surface of the housing 30 may need to be coated with copper or another material having a relatively high conductivity, as one skilled in the art would be able to deduce. Also for purposes of this description, the truss 32 is assumed to be fabricated from Invar and plated with a light coating of a material having a relatively high conductivity, in this case copper. Such a coating is necessary to minimize insertion loss and to maintain a desirable Q value. It should be noted, however, that other materials may also be used in the fabrication of the truss 32, the only requirement being that the truss 32 material have a lesser coefficient of expansion than that of the housing 30 material.

Since the truss 32 material has a lesser coefficient of expansion than the housing 30 material, the truss 32 material will exhibit lesser expansions and contractions than the housing 30 material over temperature. These differences in thermal expansions and contractions result in an increase in the dimension h' for a decrease in temperature and a decrease in the dimension h' for an increase in temperature. Likewise, a decrease in temperature results in a decrease in the dimension H' and an increase in temperature results in an increase in the dimension H'. These decreases and increases in the H' dimension correspond to the previously described natural resonant frequency measurements, whereby the result was a decrease and an increase in the natural resonant frequency of the housing 30, respectively. More importantly, however, these resulting decreases and increases in natural resonant frequency offset simultaneous increases and decreases, respectively, in the natural resonant frequency caused by thermal variations in the housing 30 material that produce corresponding variations in the dimensions of the housing 30. Thus, the truss 32 is a structure that structure that offsets, or compensates, for variations in natural resonant frequency due to thermal variations in the dimensions of the cavity resonator housing 30.

Figure 5:
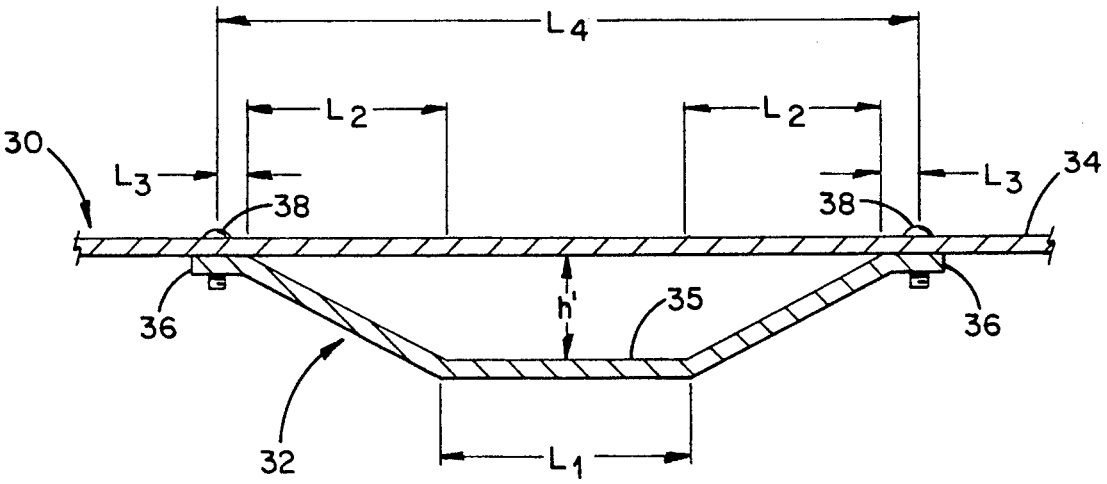
FIG. 5 is an enlarged view of FIG. 4 in the area where the truss is mounted to the housing.

Referring to FIG. 5, there is shown an enlarged view of FIG. 4 in the area where the truss 32 is mounted to the broadwall 34, and hence the housing 30. In the particular case of the housing 30 being fabricated from copper and the truss 32 being constructed of copper plated Invar, there is an effective variation in the natural resonant frequency of the resonant cavity housing 30 caused by the lesser thermal variation of the Invar material, having a coefficient of expansion of about 0.5 ppm/°F., with respect to the copper material, having a coefficient of expansion of about 9.3 ppm/°F. For example, with $L_4=3.25''$, $L_3=0.125''$, $L_2=1.0''$, $L_1=1.0''$ and $h'=0.25''$, the variation in h' is approximately $+/-0.006''$ for a 100° F. variation in temperature. It should be noted, that the plating of the truss 32 should be light enough that only the electrical properties of the truss 32 are affected and not its coefficient of expansion. Also, the thickness of the truss 32 material and the housing 30 material should be chosen so as to prevent bowing of the broadwall 34 over temperature. In the particular case of a copper housing 30 and a copper plated Invar truss 32, it has been found that the thickness of the housing 30 material should be at least twice the thickness of the truss 32 material to prevent such bowing.

Figure 6:
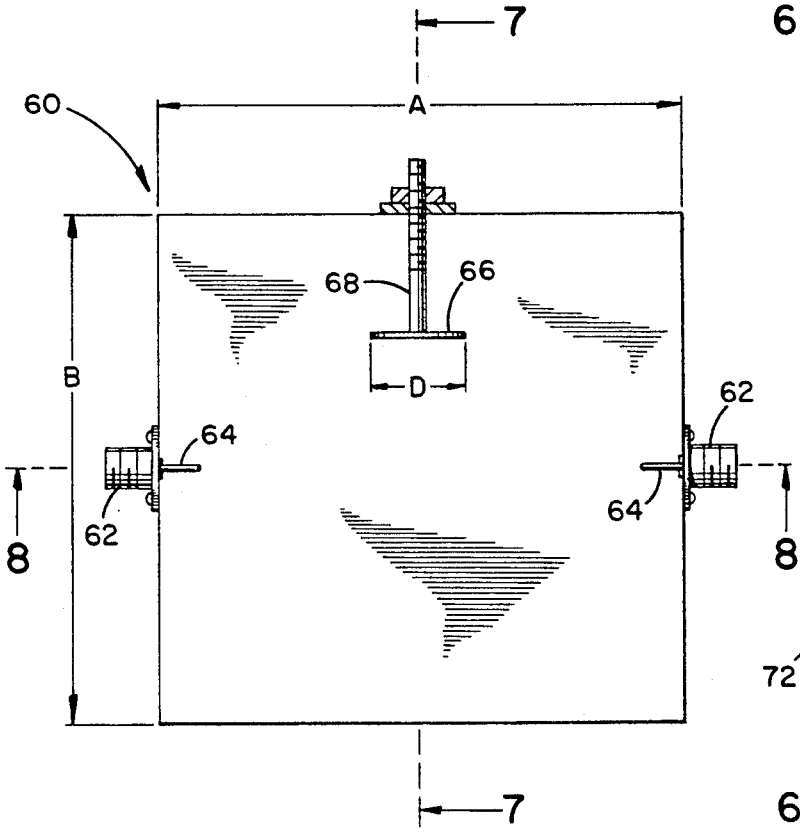
FIG. 6 is a top cross-sectional view taken along line 6—6 of FIG. 7 of a $TE_{101}$ mode cavity resonator according to the present invention.
Figure 7:
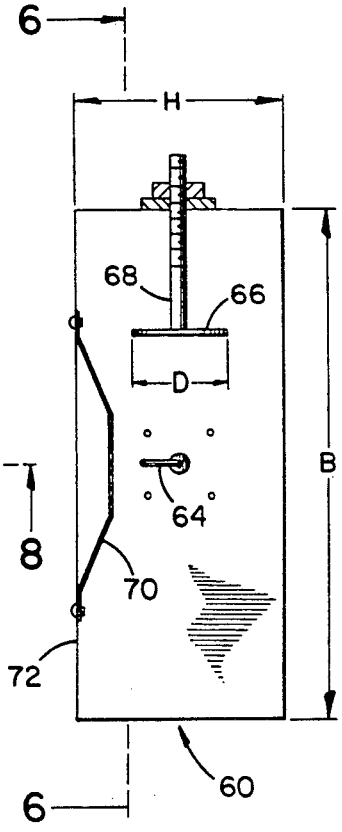
FIG. 7 is a side cross-sectional view taken along line 7—7 of FIG. 6 of a $TE_{101}$ mode cavity resonator according to the present invention.
Figure 8:
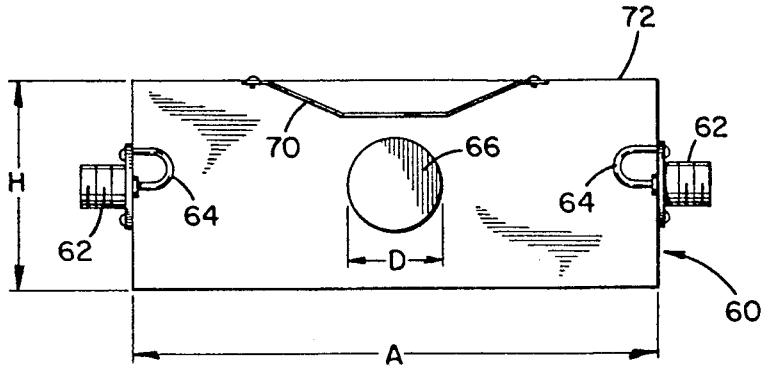
FIG. 8 is a side cross-sectional view taken along line 8—8 of FIG. 6 of a $TE_{101}$ mode cavity resonator according to the present invention.
Figure 9:
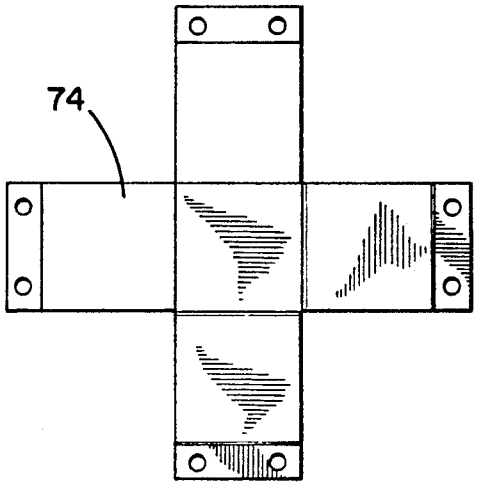
FIG. 9 is top view taken along line 9—9 of FIG. 10 of a cross-truss structure which may be used to provide temperature compensation according to the present invention.
Figure 10:
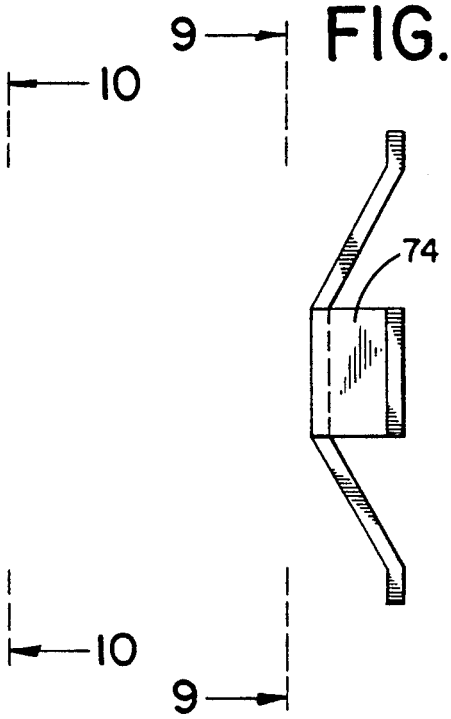
FIG. 10 is a side view taken along line 10—10 of FIG. 9 of the cross-truss structure shown in FIG. 9.
Figure 11:
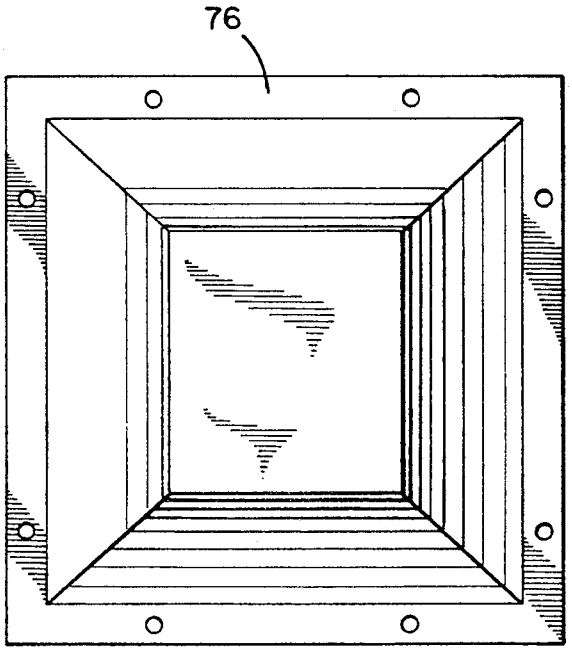
FIG. 11 is a top view taken along line 11—11 of FIG. 12 of a truncated pyramid structure which may be used to provide temperature compensation according to the present invention.
Figure 12:
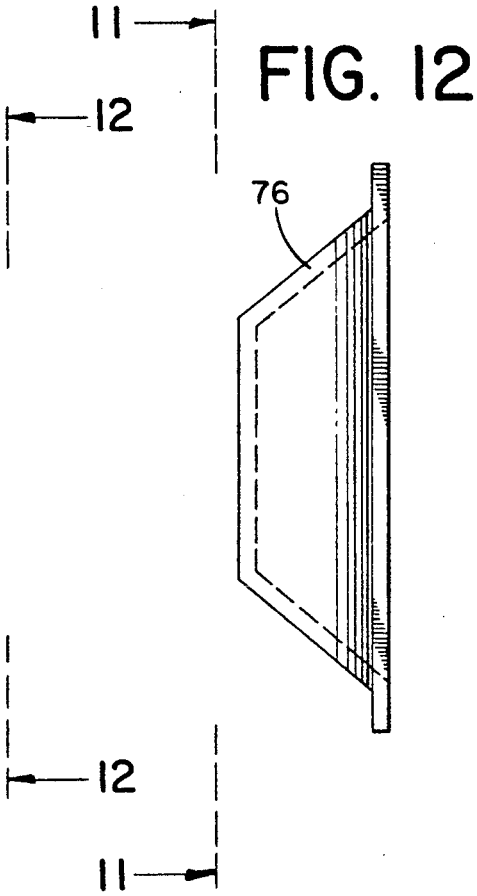
FIG. 12 is a side view taken along line 12—12 of FIG. 11 of the truncated pyramid structure shown in FIG. 11.

Referring to FIGS. 6, 7 and 8, there are shown three cross-sectional views of a $TE_{101}$ mode cavity resonator housing 60 employing the present invention truss temperature compensation method. It should be noted, however, that this method can be equally employed in a $TM_{101}$ mode cavity resonator housing, as well as many other types of cavity resonator housings. FIG. 6 shows a pair of coupling ports 62 with corresponding coupling loops 64 for providing input and output coupling to and from, respectively, the internal field distributions, as would be obvious to one skilled in the art. Also shown is a tuning disk 66 that is connected to a threaded rod 68 so as to fine tune the natural resonant frequency of the cavity resonator housing 60. Both the tuning disk 66 and the threaded rod 68 are fabricated from copper plated Invar so as to minimize insertion loss as well as any effect on the natural resonant frequency over temperature.

FIGS. 7 and 8 show the location of the truss 70 at the center of a broadwall 72 within the housing 60. It should be noted, however, that the truss 70 can be secured at other locations within the housing 60 provided that the thermal characteristics of all the relevant materials and the natural resonant frequency characteristics of the housing 60 are taken into account when determining the appropriate location. Both analytical and empirical techniques can be used to determine the appropriate location of the truss 70, and its dimensions can be varied to correspond to a particular sized housing. Thus, this temperature compensation scheme may be used in a variety of different sized cavity resonator housings, but, as previously stated, it is most practical in those housings that support $TE_{101}$ and $TM_{010}$ modes.

Finally, it should be noted that structures other than the previously described truss structure 70 can be used to provide temperature compensation according to the present invention. For example, referring to FIGS. 9 and 10, FIGS. 11 and 12, and FIGS. 13 and 14, there is shown a cross-truss structure 74, a truncated pyramid structure 76, and a truncated cone structure 78, respectively. All of these structures 74, 76, 78 can be used to provide temperature compensation in a manner similar to that of the previously described truss structure 70. However, these similar structures 74, 76, 78 are not as cost effective as the previously described truss structure 70 since they generally require more material, which can result in higher material costs and consequently higher insertion losses due to increased cavity surface area.

It is thus seen that the primary objective set forth above is efficiently attained and, since certain changes may be made in the above described apparatus and method without departing from the scope of the invention, it is intended that all matter contained in the above description or shown in the accompanying drawings shall be interrupted as illustrative and not in a limiting sense.

What is claimed is:

1. An apparatus for providing temperature compensation in a high frequency cavity resonator, said apparatus comprising in combination:

a cavity resonator housing having a high conductivity interior surface enclosing a region wherein electromagnetic fields may freely propagate, said housing being fabricated from a material having a specific coefficient of expansion, said fabricated housing having a natural resonant frequency;

coupling means for providing an input and an output connection to said enclosed region of said cavity resonator housing; and temperature compensation means in the form of a truss having a center section and a plurality of limbs extending therefrom, said temperature compensation means being physically secured to and electrically contacted with said interior surface of said cavity resonator housing at the end of each of said plurality of limbs, said temperature compensation means being fabricated from a material having a lesser specific coefficient of expansion than said cavity resonator housing material, said lesser specific coefficient of expansion resulting in a lesser thermal expansion or contraction of said temperature compensation means material than said cavity resonator housing material, said lesser thermal expansion or contraction resulting in a forced relative movement of said temperature compensation means with respect to said cavity resonator housing, said forced relative movement resulting in a first variation in said natural resonant frequency, such that said first variation in said natural resonant frequency compensates for a second variation in said natural resonant frequency caused by a thermal expansion or contraction of said cavity resonator housing material.

2. The apparatus as defined in claim 1, wherein said cavity resonator housing supports a dominant $TE_{101}$ waveguide mode by having a rectangular shape with two large walls, or broadwalls, being separated by a critical dimension.

3. The apparatus as defined in claim 2, wherein said temperature compensation means is physically secured to and electrically contacted with one of said two broadwalls so as to create a non-uniformity in said critical dimension, said non-uniformity in said critical dimension having an effect on said natural resonant frequency.

4. The apparatus as defined in claim 3, wherein said effect on said natural resonant frequency is varied as a result of said forced relative movement of said temperature compensation means, said forced relative movement resulting in a variation in said non-uniformity, said variation in said non-uniformity resulting in said first variation in said natural resonant frequency.

5. The apparatus as defined in claim 4, wherein said cavity resonator housing is fabricated from copper.

6. The apparatus as defined in claim 1, wherein said cavity resonator housing supports a dominant $TM_{010}$ waveguide mode by having a cylindrical shape with two end walls, or broadwalls, being separated by a critical dimension.

7. The apparatus as defined in claim 6, wherein said temperature compensation means is physically secured to and electrically contacted with one of said two broadwalls so as to create a non-uniformity in said critical dimension, said non-uniformity in said critical dimension having an effect on said natural resonant frequency.

8. The apparatus as defined in claim 7, wherein said effect on said natural resonant frequency is varied as a result of said forced relative movement of said temperature compensation means, said forced relative movement resulting in a variation in said non-uniformity, said variation in said non-uniformity resulting in said first variation in said natural resonant frequency.

9. The apparatus as defined in claim 8, wherein said cavity resonator housing is fabricated from copper.

10. The apparatus as defined in claim 1, wherein said coupling means comprises an input coupling probe and an output coupling probe.

11. The apparatus as defined in claim 1, wherein said temperature compensation means is formed as a truss having a center section and two limbs, said truss being secured to and electrically contacted with said interior surface of said cavity resonator housing at the end of each of said two limbs, such that said center section is spaced a predetermined distance from said interior surface.

12. The apparatus as defined in claim 11, wherein said predetermined distance is determined by said natural resonant frequency of said cavity resonator housing, said coefficient of expansion of said cavity resonator housing material, said coefficient of expansion of said truss material, and the positioning of said truss on said interior surface of said cavity resonator housing.

13. The apparatus as defined in claim 12, wherein said positioning of said truss is central on a broadwall of said cavity resonator housing.

14. The apparatus as defined in claim 1, wherein said temperature compensation means is formed as a cross-truss having a center section and four limbs, said cross-truss being secured to and electrically contacted with said interior surface of said cavity resonator housing at the end of each of said four limbs, such that said center section is spaced a predetermined distance from said interior surface.

15. The apparatus as defined in claim 14, wherein said predetermined distance is determined by said natural resonant frequency of said cavity resonator housing, said coefficient of expansion of said cavity resonator housing material, said coefficient of expansion of said cross-truss material, and the positioning of said cross-truss on said interior surface of said cavity resonator housing.

16. The apparatus as defined in claim 15, wherein said positioning of said cross-truss is central on a broadwall of said cavity resonator housing.

17. The apparatus as defined in claim 1, wherein said temperature compensation means maintains a high conductivity surface so as to minimize insertion loss.

18. The apparatus as defined in claim 17, wherein said temperature compensation means is fabricated of Invar and plated with a light coating of copper.

19. The apparatus as defined in claim 1, wherein said apparatus further comprises in combination a tuning disc and a threaded rod so as to fine tune said natural resonant frequency.

20. The apparatus as defined in claim 19, wherein said tuning disc and said threaded rod maintain a high conductivity surface so as to minimize insertion loss.

21. The apparatus as defined in claim 20, wherein said tuning disc and threaded rod is fabricated of Invar and plated with copper.

22. A method for providing temperature compensation in a high frequency cavity resonator, said method comprising the steps of:

supplying a cavity resonator housing having a high conductivity interior surface enclosing a region wherein an electromagnetic fields may freely propagate, said housing being fabricated from a material having a specific coefficient of expansion, said fabricated housing having a natural resonant frequency;

providing an input and an output connection to said enclosed region of said cavity resonator housing;

fabricating a temperature compensation means in the form of a truss having a center section and a plurality of limbs extending therefrom, said temperature compensation means being fabricated from a material having a lesser coefficient of expansion than said cavity resonator housing material, said lesser coefficient of expansion resulting in a lesser degree of expansion and contraction of said temperature compensation means material over temperature;

positioning said temperature compensation means along said interior surface of said resonant cavity housing, said position of said temperature compensation means being determined by said natural resonant frequency of said cavity resonator housing, said coefficient of expansion of said cavity resonator housing material, and said coefficient of expansion of said temperature compensation means material; and securing said temperature compensation means in said determined position along said interior surface of said resonant cavity housing at the end of each of said plurality of limbs so as to create an electrical contact between said temperature compensation means and said cavity resonator housing, said secured position of said temperature compensation means resulting in a non-uniformity in a critical dimension within said enclosed region of said cavity resonator housing, said non-uniformity in said critical dimension varying over temperature as a result of said lesser coefficient of expansion, said variation in said non-uniformity in said critical dimension resulting in a first variation in said natural resonant frequency, such that said first variation in said natural resonant frequency compensates for a second variation in said natural resonant frequency caused by expansions and contractions of said cavity resonator housing material over temperature.

23. The method as defined in claim 22, further comprising the step of plating said temperature compensation means with a light coating of copper so as to minimize insertion loss.

24. The method as defined in claim 22, further comprising the step of fine tuning said cavity resonator housing with a tuning disc and a threaded rod, wherein said tuning disc and said threaded rod are fabricated from a material having a lesser coefficient of expansion than said housing material so as to minimize their effects on said natural resonant frequency over temperature.

25. The method as defined in claim 24, further comprising the step of plating said tuning disc and said threaded rod with a light coating of copper so as to minimize insertion loss.

* * * * *